United States Patent [19]

Blanc et al.

[11] 3,958,310

[45] May 25, 1976

[54] METHOD FOR INTERLACING FILAMENTS OF MULTIFILAMENT YARNS

[75] Inventors: Charles Blanc, Couzon-Au-Mont-d'Or; Christian DeLarue, Meyzieu, both of France

[73] Assignee: Rhone-Poulenc-Textile, Paris, France

[22] Filed: Dec. 12, 1974

[21] Appl. No.: 532,238

Related U.S. Application Data

[62] Division of Ser. No. 438,684, Feb. 1, 1974, Pat. No. 3,875,625.

[52] U.S. Cl. ..... 28/72.12; 57/157 F

[51] Int. Cl.² ..... D02H 1/08; D02G 1/16

[58] Field of Search ..... 28/72.12, 1.4, 1.3, 28/72.11; 57/77.3, 157 F; 226/7, 97

[56] References Cited

UNITED STATES PATENTS

| | | | |
|---|---|---|---|
| 3,394,440 | 7/1968 | Holten | 28/72.12 X |
| 3,525,133 | 8/1970 | Psaras | 28/1.4 |
| 3,751,775 | 8/1973 | Psaras | 28/1.4 |

*Primary Examiner*—Louis K. Rimrodt

*Attorney, Agent, or Firm*—Sherman & Shalloway

[57] ABSTRACT

Multifilament yarn is interlaced by passing the yarn through an apparatus which impinges four streams or jets of fluid upon the yarn. The jets or streams of fluid are given a rotational component by auxiliary streams of air which impinge on the jets or streams with a tangential attitude. The yarn and impinging streams of fluid converge in a cavity located within an interlacing chamber wherein the height of the cavity is no greater than the smallest diameter of the cavity and wherein the inlet of the interlacing chamber is wider than the diameter of the cavity and the outlet of the interlacing chamber is narrower than the cavity.

2 Claims, 7 Drawing Figures

METHOD FOR INTERLACING FILAMENTS OF MULTIFILAMENT YARNS

This is a division of application Ser. No. 438,684, filed Feb. 1, 1974, now U.S. Pat. No. 3,875,625, granted Apr. 8, 1975.

BACKGROUND OF THE INVENTION

1. Field of the Invention

The instant invention relates to methods of and apparatus for the manufacture of multifilament yarns having interlaced filaments. More particularly, the instant invention relates to methods and apparatus for the manufacture of multifilament yarns having interlaced filaments wherein the filaments are interlaced by impinging at least one stream of fluid on the yarn.

2. Technical Consideration and Prior Art

The filaments of multifilament yarns are cohered together by processes such as twisting, sizing or interlacing. The present invention is directed to interlacing wherein a yarn formed of continuous multifilaments is interlaced or tangled in a generally random way to form "pseudo burls" which cooperate to form a yarn that has a total twist which may be substantially zero.

The prior art suggests several processes for the manufacture of interlaced yarn. These processes include subjecting the yarn, while under slight tension, to the action of at least one fluid jet which is generally created by compressed air. Generally the jet is directed in a plane that is substantially normal to the direction in which the yarn advances and is impinged on the yarn as the yarn traverses what is generally known as an "interlacing nozzle" or "interlace nozzle."

The patent literature, especially the French patent literature, contains many examples of interlacing methods and apparatus for utilization in interlacing the fibers of multifiber yarn. In Addition No. 68,429 to French Pat. No. 1,108,890 a strand of multifiber yarn is advanced between a delivery tube which impinges fluid against the strand and a resonance box. An improvement to this invention is disclosed in French Pat. No. 1,334,130 in which the impinging fluid is recycled from the outlet of the resonance box and again impinged on the yarn.

French Pat. No. 1,492,945 discloses a process in which a multifilament strand of yarn is subjected simultaneously to impingement from pairs of primary fluid jets and at least one secondary jet which impinges fluid on the yarn from a direction opposite that of the primary jets in a zone between the points of impact of the primary jets.

French Pat. No. 2,094,232 discloses a process in which yarn is passed through a conduit and subjected to impingement from two fluid jets which are substantially aligned with the conduit but are oppositely directed.

The aforedescribed processes impinge substantially rectilinear fluid jets on multifilament yarns to interlace the filaments of the yarns. However, there is another approach in which the multifilament yarn is advanced through a zone or station in which there is vortex turbulence created by impinging fluid jets on the yarn which have an axis of rotation which is substantially parallel to the direction in which the yarn advances. In the processes disclosed in these patents, the fluid is fed directly into a conduit forming the interlacing zone or station and the vortex turbulence is formed in the conduit itself. Consequently, in order for the vortex turbulence to be effective, the conduit must extend a relatively long distance and a plurality of inlets for the fluid jets need to be distributed in the conduit along the path therethrough assumed by the yarn.

U.S. Pat. No. 2,191,791 discloses a yarn guide composed of a cavity, the height of which is at most equal to the diameter thereof. As the yarn passes through the cavity, a plurality of radial jets impinge fluid streams upon the yarn and as a result of the action of radial streams, the yarn is interlaced.

French Pat. application No. 72/19404, filed May 25, 1972, now French Pat. No. 2,186,029 in the name of the inventor of the instant invention and entitled "Process and Device for the Manufacture of Interlaced Strand Yarn" is subjected to impingement from jets which generate a perturbed fluid flow. By the term perturbed fluid flow is meant a stream of fluid having a direction and possibly an output which is temporarily variable. With the process disclosed in this application, the interlacing quality of the multifilament yarn is very good because over short lengths there is a random pattern of interlacing without a geometric repetition whereas, over long lengths, the yarn has a pleasing regular appearance. Unfortunately, the apparatus for practicing the process disclosed in this application is rather complicated because it relies on movable mechanical elements to cause perturbation of the fluid jets. Furthermore, this process is relatively noisy and the mechanical elements involved are subject to rapid wear. Finally, it is difficult to obtain similarities in interlacing configurations produced by different nozzles.

SUMMARY OF THE INVENTION

In view of the aforementioned difficulties encountered upon using the methods and apparatus of the prior art, it is an object of the instant invention to provide new and improved methods of and apparatus for interlacing the filaments of multifilament yarn.

It is another object of the instant invention to provide new and improved methods of and apparatus for interlacing the filaments of multifilament yarn by utilizing a relatively simple apparatus which has no parts that move while the interlacing process is being effected.

It is another object of the instant invention to provide new and improved methods of and apparatus for interlacing filaments of multifilament yarns wherein the interlaced filaments have improved cohesion.

It is still another object of the instant invention to provide new and improved methods of and apparatus for interlacing filaments of multifilament yarn wherein it is possible to obtain various interlacing configurations with the same apparatus.

It is a further object of the instant invention to provide new and improved methods of and apparatus for interlacing filaments of multifilament yarn wherein interlacing occurs upon impinging a fluid jet on the yarn wherein the fluid jet has a rotating component.

In keeping with these objects and additional objects, the present invention contemplates an apparatus for interlacing the filaments of a multifilament yarn under the influence of an expanding pressurized fluid by advancing the yarn through an interlacing chamber having a treatment zone with which is registered at least one conduit that directs a fluid jet or stream against the yarn. The apparatus includes a structure which is aligned with the conduit and superimposes a rotational component on the stream passing through the conduit to cause an enhanced interlacing of the filaments. The treatment zone is dimensioned so that its height is at most equal to its diameter. The present invention also contemplates methods utilizing the features of the aforedescribed apparatus.

DETAILED DESCRIPTION

Figure 1:
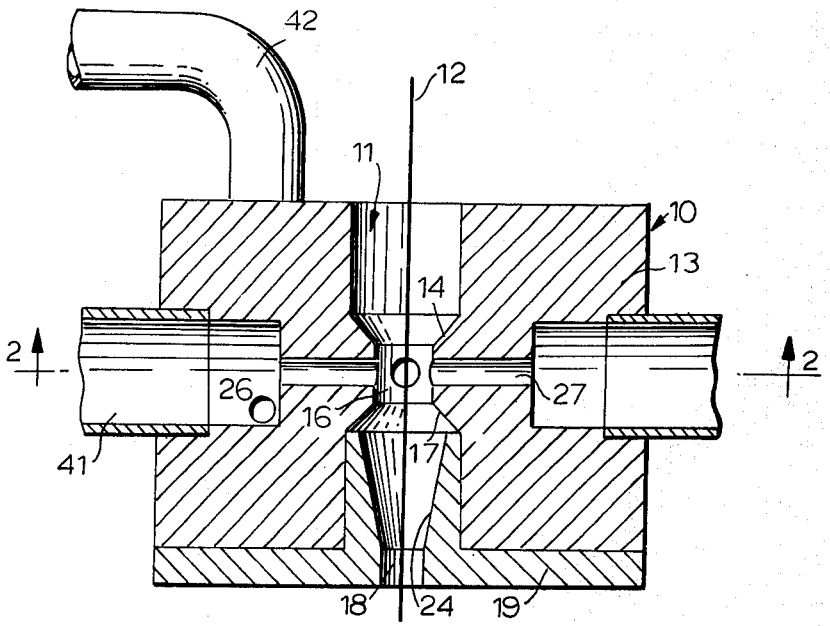
FIG. 1 is a side view of a nozzle according to the instant invention taken in section to show an interlacing chamber and fluid conduits.
Figure 2:
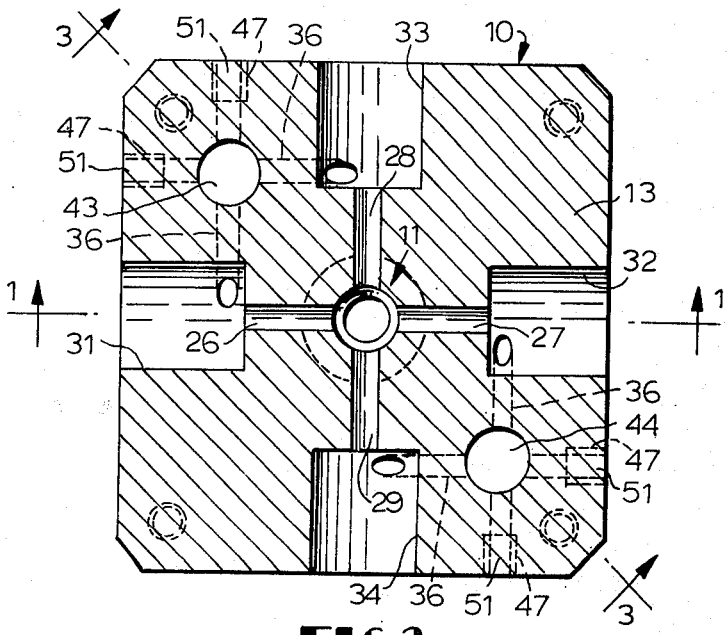
FIG. 2 is a top view of the nozzle in FIG. 1 taken in section along line 2—2 of FIG. 1 showing four conduits registering with the interlacing chamber.

Referring now to FIG. 1, there is shown a nozzle, designated generally by the numeral 10, which is the apparatus for performing the process of the instant invention. The nozzle 10 has an interlacing chamber, designated generally by the numeral 11, through which passes a multifilament strand of yarn 12 and in which the filaments of the yarn 12 are interlaced to form a unified strand of yarn. As seen in FIG. 2, the interlacing chamber is a generally cylindrical bore formed in a block 13.

Figure 3:
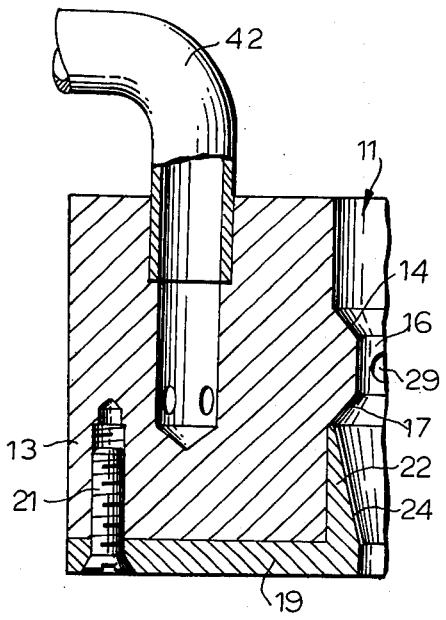
FIG. 3 is a half view taken in section along line 3—3 of the nozzle shown in FIG. 2 illustrating how a fluid supply line is registered with the nozzle.

In the illustrated embodiment, the interlacing chamber 11 maintains its cylindrical configuration for a certain distance and then tapers with a conical portion 14 to form what is herein described as a treatment zone 16. Downstream of the treatment zone 16, the interlacing chamber 11 expands through another beveled portion 17 and continues to an outlet 18. In the embodiment shown in FIG. 1, a plate 19 is bolted by screws 21 (see FIG. 3) to the block 13. The plate 19 has a projecting portion 22 which extends therefrom to form a converging outlet 24 therein, the purpose of which will be explained hereinafter.

The treatment chamber 16 has an axial length which is substantially equal to its diameter. However, th axial length of the treatment chamber may, if desired, be less than the diameter. Registered with the treatment chamber 16 are pairs of opposed jets 26 and 27 extending along one axis, and 28 and 29 extending along another axis, positioned normal to the first axis. In the illustrated embodiment, the axes of the jets are all included in the same plane, which plane is perpendicular to the longitudinal direction of advance assumed by the yarn 12. Through these jets 26, 27, 28 and 29, fluid is passed to impinge on the yarn 12. All fluid flowing through these jets flows into the treatment zone 16.

The jets 26, 27, 28 and 29 have vortex chambers 31, 32, 33 and 34 respectively associated therewith. These vortex chambers are axially aligned with the jets. In order to generate vertices within the vortex chambers 31, 32, 33 and 34, each vortex chamber has a tangential jet 36 registered therewith in a direction which is tangent to the axes of the vortex chambers and the jets 26, 27, 28 and 29.

Connected to each vortex chamber is a principal fluid supply conduit 41 which supplies the fluid stream that expands through the jets 26, 27, 28 and 29, to impinge upon the yarn 12. As the principal fluid is supplied through the conduits 41, the tangential jets 36 supply an auxiliary fluid in a direction which is tangential to the flow of the principal fluid. This causes the principal fluid to rotate and form vertices which generally rotate about the axes of the jets 26–29 and the vortex chambers 31–34. The auxiliary fluid is applied via conduits 42 (see FIGS. 1 and 3) that register with bores 43 and 44 in the block 13. The bore 43 communicates with vortex chambers 31 and 33 through tangential jets 36 while the bore 44, which is diagonally spaced from the bore 43, communicates with vortex chambers 32 and 34 through tangential jets 36. By configuring the bores 43 and 44 in this way, it is possible to rotate the vortices in vortex chamber 31 in the opposite direction from the vortices generated in the vortex chamber 32. Furthermore, the vortices in vortex chamber 33 are rotated in the opposite direction from the vortices in the vortex chamber 34. This, of course, occurs because the tangential jets communicating with opposed vortex chambers 31,32 and 33,34 are directed in opposite directions.

The block 13 has threaded holes 47 machined therein through which may be introduced valves 51 that may be registered with the jets 36 to constrict the inlet ends of the jets to throttle the amount of fluid entering the jets and thereby control the the intensity of vortices generated in the vortex chambers 31–34. By utilizing the valves 51, the vortices in selected ones of the chambers 31–34 may be varied selectively so that fluid impinging on the yarn 12 through the jets 26–29 may have varying rotation components. This produces different variations in interlacing configurations given to the multifilament yarn 12. If desired, of course, selected ones of the jets 36 may be cut off completely by the valves 51 so that the principal fluid stream applied through the associated vortex chamber will have no rotational component.

In addition to utilizing the bores 47 for varying rotational components of the principal fluid, the bores 47 may also be used upon removal of the valves 51 to inject auxiliary fluids, such as dyes or other processing fluids, into the principal fluid. Furthermore, the bores 47 are, or may be, created as a convenient access for boring the jets 36 through the block 13.

Figure 4:
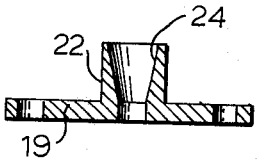
FIG. 4 is a side view in section showing a plate which is utilized for partial closure of the outlet end of the interlacing chamber shown in the previous figures.
Figure 5:
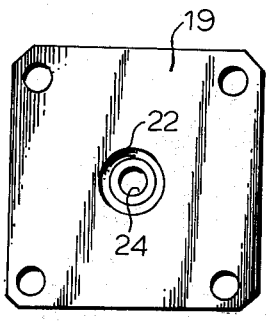
FIG. 5 is a top view of the plate shown in FIG. 4.
Figure 6:
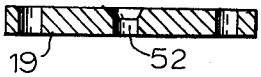
FIG. 6 is another embodiment of a plate which is used for partial closure of the outlet of the interlacing chamber.

Referring now to FIGS. 4, 5 and 6, there are shown two types of plates which are used to partially constrict the outlet 18 of the interlacing chamber 11. The embodiment shown in FIG. 4 has already been described and utilizes a converging portion 24 which is conical to gradually constrict the outlet from the interlacing chamber 11. The embodiment of FIG. 6 shows a different configuration of the plate 19 wherein the outlet 18 of the interlacing chamber 11 may be constricted by an abrupt orifice 52.

Although no constricting means is shown as being applied to the intake or upstream end of the interlacing chamber 11, such a device may be utilized if desired.

Figure 7:
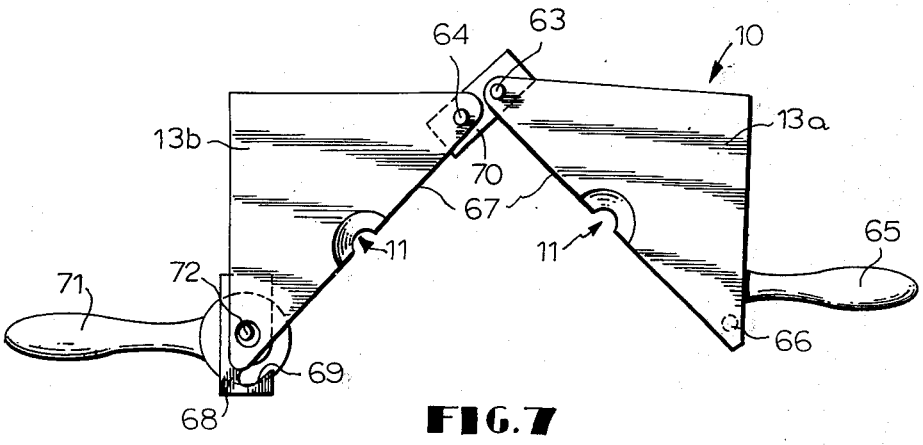
FIG. 7 is a top view of an embodiment of the nozzle according to the invention which can be pivoted to an open position to receive multifilament yarn therethrough in a convenient manner.

Referring now to FIG. 7, there is shown an embodiment of the nozzle 10 wherein the block 13 is divided into a pair of symmetrical portions **13*a* and 13*b* so that the block may be conveniently opened for insertion of a multifilament yarn 12. By utilizing the configuration shown in FIG. 7, the yarn does not have to be first severed and threaded through the nozzle 10 in order to apply the nozzle 10 to the yarn. In the embodiment illustrated in FIG. 7, the two halves 13***a* and 13*b* are pivoted by pins 63 and 64 to a plate 70 so as to swing toward and away from one another. The portion 13*a* has a handle 65 rigidly secured thereto and a pin 66 projecting therefrom. When the halves 13*a* and 13*b* are pivoted into abutting relationship along the interface 67, the pin 66 is engaged by a latch 68. The latch 68 has a curved slot 69 therein which engages the pin 66 and captures as a handle 71 is rotated in the counterclockwise direction. In order to, in effect, cam the two halves 13*a* and 13*b* together, the handle 71 is pivoted offcener about a pin 72 so as the handle is rotated the pin 66 is drawn progressively closer to the pin 72. By utilizing the arrangement of the off-center latch 68 and plate 70, an articulated locking system is provided in which absorption of play between the two halves 13*a* and 13*b* may be accomplished by auxiliary structures, such as spring washers, positioned to act between the two halves 13*a* and 13*b*.

While in the illustrated embodiment the fluid utilized is air, it should be kept in mind that any other gas or liquid or a diphase liquid, such as an emulsion, may be used. In addition, it should be kept in mind that the fluid utilized may contain a dye.

Furthermore, although the interlacing chamber 11 and treatment zone 16 disclosed in the drawings are generally cylindrical in configuration, it should be kept in mind that these portions of the nozzle 10 may have a surface defined by any convenient surface of revolution so that the diameter may vary from one end to the other.

Although the jets 26, 27, 28 and 29 are shown having axes all in the same plane, these jets may be inclined relative to that plane so as to generate a traction on the yarn 12 as the fluid passes through the jets and impinges on the yarn.

While four jets 26, 27, 28 and 29 are illustrated as being positioned at an angle of 90° to one another, it is possible to utilize any number of jets the angle between which may vary between 0° and 80° and preferably may vary between 30° and 80°.

In the illustrated embodiment, the fluid ejected from adjacent jets may rotate in the same direction or in opposite directions. If the fluid from adjacent jets rotates in opposite directions, it is possible to avoid parasitic false twist effects on the multifilament yarn as it is interlaced.

Although the jets 26–29 and the vortex chambers 31–34 are shown as having cylindrical side walls, it is also possible to profile these structures to have the form of a Laval nozzle which is convergent and divergent. Such a configuration would enhance the speed of ejection of fluids through these structures while at the same time reducing consumption of fluid to produce the same interlacing effect on the yarn.

Finally, the configuration of the yarn 12, as it emerges from the interlacing chamber 11, may be varied according to whether or not the outlet 18 of the chamber is constricted. If the outlet of the chamber is constricted by, for example, the converging surface 24 shown in FIGS. 1, 3 and 4, or the converging surface 52 shown in FIG. 5, an improvement in yarn cohesion results because the exit speed of the fluid is increased. If the opening 18 is wider than the diameter of the treatment zone, then the yarn, as it exits from the interlacing chamber, will swell creating an effect which might, under some circumstances, be desired.

EXAMPLES

By using the nozzle 10 shown in FIGS. 1-6, the following results were obtained.

EXAMPLE 1

Texturized polyamide yarn having a count of 2800 *dtx*/136 strand was processed using the nozzle 10 and the plate 19 with the gradually converging outlet defined by surface 24. Compressed air was applied to the conduits 41 and 42 with the same pressure. For a given passage of the yarn through the nozzle 10, the quality of the interlacing of the yarn was measured as a function of this pressure. The operation as repeated for different speeds and the pressure read on a manometer and expressed in bars.

The cohesion factor of the interlacing was measured on an "entanglement tester R-2040," Rothschild (Zurich). This entanglement tester works on the principal of automatic detection of the distance between points of interlacing by utilizing a needle that penetrates between the filaments of a moving yarn and retracts as soon as it encounters a point of resistance, the point of resistance being an interlace point. The yarn being tested is first subjected to a known adjustable pretensioning. Since the threshold of tension that corresponds to disengagement of the needle from the yarn is known and adjustable, the cohesion factor can be expressed by the relationship: $F = 100/d$ wherein $d$ is the average distance between interlace points expressed in centimeters and is the average of at least 100 measurements. The values of the interlace factor are presented in the following table in which P.I. is the injection pressure of the principal fluid, P.T. is the injection pressure of the auxiliary fluid used to create the turbulence and V is the yarn speed in meters per minute.

Table I

| P.I.=P.T. V. fil | 0.5 | 1 | 1.5 | 2 | 3 | 4 | 5 | 6 |
|---|---|---|---|---|---|---|---|---|
| 200 | 10.6 | 24.3 | 27.1 | 38.6 | 47.4 | 48.8 | 65.5 | 58.5 |
| 300 | 9.68 | 20.1 | 25.4 | 35.5 | 45.5 | 56.9 | 50.7 | 55.6 |
| 400 | 11.9 | 16.8 | 26.2 | 26.6 | 43 | 49.4 | 52.2 | 53.7 |
| 1070 | — | 7.2 | — | 18.5 | 29.5 | 35.1 | 40.1 | — |

A review of Table I results in the following observations:

1. For a given speed, the interlace factor is in direct proportion to the fluid pressure;
2. For yarn passage speeds taken in a narrow range, the speed has little influence on the interlace factor; and
3. If the passage speeds vary in large proportions, the interlace factor is in inverse proportion to the speed.

EXAMPLE 2

The operating conditions in this example are the same as in Example 1 except that the nozzle fuctioned without feeding turbulence fluid. In this example, no fluid pressure was applied to conduits 42 while the conduits 41 were pressurized.

Table II

| P.I. V. fil | 0.5 | 1 | 1.5 | 2 | 3 | 4 | 5 | 6 |
|---|---|---|---|---|---|---|---|---|
| 200 | 9.69 | 22.5 | 30.2 | 40.7 | 48.4 | 54.2 | 61.4 | 58.8 |

Table II-continued

| P.I. / V. fil | 0.5 | 1 | 1.5 | 2 | 3 | 4 | 5 | 6 |
|---|---|---|---|---|---|---|---|---|
| 300 | 13.9 | 17.4 | 30.4 | 39.5 | 50 | 55.1 | 49.6 | 55 |
| 400 | 7.57 | 15.4 | 25.5 | 30.7 | 42.7 | 45.1 | 47.7 | 54.4 |

A review of Table II results in the following observations:

1. For a given speed of yarn passage, the interlace factor is directly proportional to the injection pressure; and
2. At rather a narrow speed range, the speed has little effect on the value of the interlace factor.

COMPARISON OF EXAMPLES 1 AND 2

In comparing Examples 1 and 2, it is observed that the interlacing factor is in direct proportion to the flow of fluid in the nozzle. It is seen that the degree of interlace of the yarn obtained with the nozzle functioning with turbulent fluid and that of the nozzle functioning without turbulent fluid are substantially equivalent. However, in the case of the nozzle functioning with turbulent fluid, it is found that the flow of air passing through the nozzle is substantially reduced on the order of 20–40%. Consequently, there is a considerable saving in fluid. Furthermore, the interlace produced is more regular, as evidenced by the separation of measurements on the Rothschild apparatus which deviates from the average less. The resulting yarn appears more regular, more sheathed and with very slight variations in diameter when turbulence is utilized.

EXAMPLE 3

In this example, the pressure of the primary fluid was kept constant while the pressure of the turbulence-causing fluid was varied. In this example, there were three series of tests:

First series

The primary injection fluid pressure was held constant at 1 bar while three tests corresponding to yarn speeds of 200, 300 and 400 meters per minute were run. The pressure of the turbulence-causing fluid was varied and the results are recorded in Table III.

Second series

The same tests were made as with the first series; however, the primary injection fluid pressure was maintained at 1.5 bars. The results of this series are illustrated in Table IV.

Third series

The same tests were conducted as with the first and second series; however, the primary injection fluid pressure was maintained at 2 bars. The results of these tests are in Table V.

Table III

| P.T. / V. fil | 0 | 0.5 | 1 | 1.5 | 2 | 3 | 4 | 5 | 6 |
|---|---|---|---|---|---|---|---|---|---|
| 200 | 22.5 | 24.3 | 24.3 | 16.1 | 21.7 | 26.7 | 27.9 | 34.2 | 30.1 |
| 300 | 17.4 | 17 | 20.1 | 16.3 | 18.5 | 24.4 | 25.5 | 31.4 | 31.9 |
| 400 | 15.4 | 17.3 | 16.8 | 15 | 18.2 | 20.5 | 29 | 31.2 | 36.5 |

Table IV

| P.T. / V. fil | 0 | 1 | 1.5 | 2 | 3 | 4 | 5 | 6 |
|---|---|---|---|---|---|---|---|---|
| 200 | 30.2 | 30.6 | 27.1 | 29.8 | 23.5 | 30.6 | 24.7 | 32.3 |
| 300 | 30.4 | 29.8 | 25.4 | 29.8 | 19.5 | 28.8 | 37 | 38.2 |
| 400 | 26.5 | 26.5 | 26.2 | 27.5 | 22.3 | 29.6 | 28.3 | 37 |

Table V

| P.T. / V. fil | 0 | 1.5 | 2 | 3 | 4 | 5 | 6 |
|---|---|---|---|---|---|---|---|
| 200 | 40.7 | 43.6 | 38.6 | 32 | 16.1 | 32.1 | 31.9 |
| 300 | 39.5 | 43.2 | 35.5 | 40.5 | 22.8 | 39.6 | 38.4 |
| 400 | 30.7 | 32.8 | 26.6 | 31 | 20.2 | 33.7 | 34.1 |

In interpreting Tables III, IV and V, it is seen that the interlace factor varies as a function of the turbulence-causing fluid pressure. There is a minimum interlace factor which, for a given pressure of injection fluid, is the same at the same turbulence causing fluid pressure. Thus, for a fixed value of the injection pressure, it is possible to modulate the value of the interlace factor by varying the pressure of the turbulence-causing fluid. By optimizing the pressure of the primary injection fluid and the pressure of the turbulence-causing fluid, it is possible to achieve the best nozzle efficiencies by utilizing minimum flow through the nozzle. Consequently, it is possible to enhance cohesion of the interlaced filaments by using a speed resumption device such as the plate 19 at the outlet 18 of the interlacing chamber.

In addition to the aforementioned advantage, the regularity of the interlace may be improved by utilizing the nozzle according to this invention since the nozzle can function using various arrangements such as activating two of the turbulence-causing jets with two non-turbulence-causing jets or any symmetrical or asymmetrical mix of activated turbulence-causing jets. Consequently, it is possible to obtain yarns having different configurations of interlace by using a single nozzle 10. It is also possible, with the nozzle 10 of the present invention, to produce effects such as false twist, etc. Finally, the nozzle utilized in the instant invention may interlace many types of multifabric yarns such as continuous yarns, spun products of fibers, yarns which are either flat or textured, yarns which are natural or yarns which are made of artificial or synthetic materials.

The aforedisclosed embodiments and examples are merely illustrative of the features of the instant invention, which is to be limited by only the following appended claims.

What is claimed is:

1. A method of interlacing multifilament yarn by utilizing expanding fluid comprising the steps of:

advancing the yarn through a work station; and impinging at least one jet of fluid on the yarn from a direction normal to the direction of advance of the yarn wherein the fluid has a rotational component imparted thereto before impinging on the yarn, wherein the axis of the rotational component is normal to the direction of advance of the yarn.

2. The method of claim 1 wherein a plurality of said fluid jets impinge on the advancing yarn and wherein the fluid jets are disposed in the same plane and are displaced relative to one another at an angle of between 30° and 180°.

* * * * *

UNITED STATES PATENT AND TRADEMARK OFFICE

CERTIFICATE OF CORRECTION

PATENT NO. : 3,958,310

DATED : May 25, 1976

INVENTOR(S) : BLANC, ET AL.

It is certified that error appears in the above-identified patent and that said Letters Patent are hereby corrected as shown below:

Please insert the following Foreign Application Priority Data:

-- March 5, 1973 France ..... 73/08029 --

Signed and Sealed this

Thirtieth Day of November 1976

[SEAL]

*Attest:*

RUTH C. MASON
*Attesting Officer*

C. MARSHALL DANN
*Commissioner of Patents and Trademarks*